US009723871B2

(12) United States Patent
Xiang

(10) Patent No.: US 9,723,871 B2
(45) Date of Patent: Aug. 8, 2017

(54) ELECTRONIC CIGARETTE AND CONTROL METHOD THEREOF

(71) Applicant: Zhiyong Xiang, Shenzhen (CN)

(72) Inventor: Zhiyong Xiang, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 1120 days.

(21) Appl. No.: 13/895,655

(22) Filed: May 16, 2013

(65) Prior Publication Data

US 2014/0305450 A1 Oct. 16, 2014

(30) Foreign Application Priority Data

Apr. 16, 2013 (CN) ..... 2013 1 0131568

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2009/0230117 A1* 9/2009 Fernando et al. .... A24F 47/008 219/490
2012/0048266 A1* 3/2012 Alelov ..... A61M 11/005 128/202.21
2013/0220315 A1* 8/2013 Conley et al. ..... A61M 11/042 128/202.21
2014/0157583 A1* 6/2014 Ward et al. ..... H05B 3/00 29/611

* cited by examiner

*Primary Examiner* — Michael H Wilson
*Assistant Examiner* — Dionne Walls Mayes
(74) *Attorney, Agent, or Firm* — Tim Tingkang Xia, Esq.; Locke Lord LLP

(57) ABSTRACT

The present invention discloses an electronic cigarette and a method for disposing smoking data of the electronic cigarette. The electronic cigarette includes a microcontroller, a smoking signal detecting module and a memory that are both connected with the microcontroller; the smoking signal detecting module configured to detect smoking signals and send the smoking signals to the microcontroller; the microcontroller configured to record a time of each reception of the smoking signals and a continuation time length of each received smoking signal, and calculate a smoking data according to the time and the continuation time length; the memory configured to store the time, the continuation time length and the smoking data; the smoking data including a time interval between every two smoking signals and a number of receiving the smoking signals during a preset period. The smoking data of the users using the electronic cigarette can be recorded and stored.

2 Claims, 4 Drawing Sheets

ELECTRONIC CIGARETTE AND CONTROL METHOD THEREOF

CROSS-REFERENCE TO RELATED APPLICATIONS

This non-provisional application claims priority under 35 U.S.C. §119(a) on Patent Application No. 201310131568.2 filed in P.R. China on Apr. 16, 2013, the entire contents of which are hereby incorporated by reference.

FIELD OF THE INVENTION

The present invention relates to the field of electronic cigarette, and more particularly relates to an electronic cigarette and a method for disposing smoking data of the same.

BACKGROUND OF THE INVENTION

At present, electronic cigarettes are more and more popular with smokers. Smokers use electronic cigarettes to decrease the harm to their bodies. For further decreasing the harm to smokers, some use of electronic cigarettes need to record the number of smoking times every day and a time length of each smoking process. Some doctors may also need to record the number of using electronic cigarettes, the time length of each smoking process, time intervals between every two adjacent smoking processes, and a distribution of time for smoking of smokers, and then make a health care plan for smokers according to those data. If such smoking data of a smoker is obtained, it will be benefit for the smoker to know his/her smoking state, and a doctor can also be provided with useful data. However, the existing electronic cigarettes have not the functions of data storage and data transmission, so these data can only be obtained by the way of manual calculation. Using manual ways may cause wrong records, data omissions or data deviations.

SUMMARY OF THE INVENTION

Aiming at the drawbacks in the prior art that the existing electronic cigarettes cannot store and transmit data, such as a number of smoking times, time intervals between every two adjacent smoking processes and so on. An electronic cigarette and a method for disposing a smoking data of the same are provided in the present invention.

An electronic cigarette comprises: a microcontroller, and a smoking signal detecting module and a memory that are both connected with the microcontroller;

wherein the smoking signal detecting module is configured to detect smoking signals and send the smoking signals to the microcontroller;

wherein the microcontroller is configured to record a time of each reception of the smoking signals and a continuation time length of each received smoking signal, and calculate a smoking data according to the time of each reception of the smoking signals and a continuation time length of each received smoking signal;

wherein the memory is configured to store the time of each reception of the smoking signals, the continuation time length of each received smoking signal;

wherein the smoking data includes a time interval between every two smoking signals and the number of receiving the smoking signal during a preset period.

The electronic cigarette further comprises a data transmission module, wherein the data transmission module connected with the microcontroller is configured to transmit the time of each reception of the smoking signals and a continuation time length of each received smoking signal and the smoking data to an external device.

The data transmission module is a USB interface, an I2C interface, an RS232 interface, an SPI interface, an infrared interface or a radio frequency interface.

The radio frequency interface transmits the data in the frequency of 315 MHz, 433 MHz or 900 MHz.

The data transmission module is a wifi module, a Zigbee module, a Bluetooth module or an NFC module.

The smoking signal detecting module is a sensor or an input module.

The input module is a keyboard input module or a touch screen input module.

The electronic cigarette further comprises a display module, wherein the display module connected with the microcontroller is configured to display the time of each reception of the smoking signals and a continuation time length of each received smoking signal and the smoking data.

The display module is an LCD panel or an LED panel.

The electronic cigarette further includes a semiconductor switch, an atomizer and a power supply battery, the semiconductor switch is connected with the microcontroller, the atomizer and the power supply battery;

wherein the microcontroller is also configured to compare the number of reception of the smoking signal with a preset first threshold, and/or compare the continuation time length of each received smoking signal with a preset second threshold;

wherein when the number of receiving the smoking signal exceeds the first threshold and/or the continuation time length of each received smoking signal exceeds the second threshold, the microcontroller controls the semiconductor switch to be OFF and the power supply battery stops supplying power to the atomizer.

The electronic cigarette further comprises a speaker, and wherein when the number of receiving the smoking signal exceeds the first threshold and/or the continuation time length of each received smoking signal exceeds the second threshold, the microcontroller controls the display module and/or the speaker to output prompting message for users.

The semiconductor switch is any one of a triode, a MOS tube, a transistor and a thyristor.

The memory is a flash memory chip or an EEPROM chip.

The microcontroller is a MCU or a CPU.

An electronic cigarette comprises a microcontroller and a smoking signal detecting module connected to the microcontroller;

wherein the smoking signal detecting module is configured to detect a smoking signal and send the smoking signal to the microcontroller;

wherein the microcontroller is configured to record a time of each reception of the smoking signals and a continuation time length of each received smoking signal, and calculate a smoking data according to the time of each reception of the smoking signals and a continuation time length of each received smoking signal;

wherein the memory is configured to store the time of each reception of the smoking signals, the continuation time length of each received smoking signal;

wherein the smoking data includes a time interval between every two smoking signals and the number of receiving the smoking signal during a preset period.

A method for disposing smoking data of electronic cigarette comprises the following steps:

a smoking signal detecting module detecting a smoking signal and sending the smoking signal to a microcontroller;

the microcontroller recording a time of each reception of the smoking signals and a continuation time length of each received smoking signal, and calculating a smoking data according to the time of each reception of the smoking signals and a continuation time length of each received smoking signal;

a memory storing the time of each reception of the smoking signals, the continuation time length of each received smoking signal and the smoking data;

wherein the smoking data includes a time interval between every two smoking signals and the number of receiving the smoking signal during a preset period.

The method for disposing smoking data of electronic cigarette further comprises: transmitting of each reception of the smoking signals and a continuation time length of each received smoking signal and the smoking data to an external device and displaying them on a display module.

The method for disposing smoking data of electronic cigarette further comprises:

comparing the number of receiving the smoking signal with a preset first threshold and/or comparing the continuation time length of each received smoking signal with a preset second threshold; wherein when the number of receiving the smoking signal exceeds the first threshold and/or the continuation time length of each received smoking signal exceeds the second threshold, the microcontroller controls the semiconductor switch to be OFF and the power supply battery stops supplying power to the atomizer.

The method for disposing smoking data of electronic cigarette further comprises:

when the number of receiving the smoking signal exceeds the first threshold and/or the continuation time length of each received smoking signal exceeds the second threshold, the microcontroller controls the display module and/or the speaker to output prompting message for users.

When implementing the invention, the following advantages can be achieved: the smoking data of uses of electronic cigarettes can be stored and transmitted to external devices to analyze and process; and when the smoking data exceeds the threshold values, the electronic cigarette can prompt the users to make them use the electronic cigarette properly.

BRIEF DESCRIPTION OF THE DRAWINGS

The present invention can be further illustrated by reading the example with references made to the accompanying drawings, in which.

DETAILED DESCRIPTION OF THE PREFERRED EMBODIMENT

For recognizing the technique character, the object and the effect more clearly, the special implement of the invention is illustrated in detail with references to the accompanying drawings.

Figure 1:
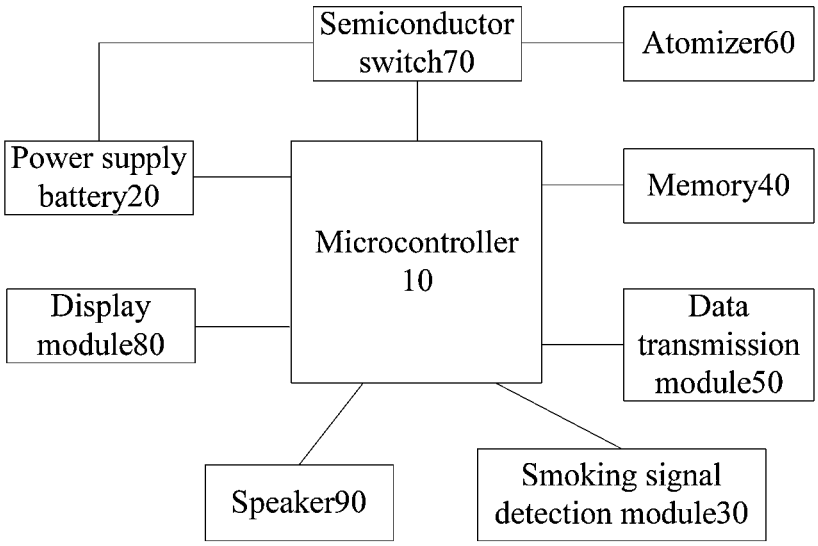
FIG. 1 is a block diagram of an electronic cigarette according to a first embodiment of the present invention.

As shown in FIG. 1, a block diagram of an electronic cigarette according to a first embodiment of the present invention. In this embodiment, the electronic cigarette includes: a microcontroller 10, a power supply battery 20, a smoking signal detecting module 30, a memory 40, a data transmission module 50, an atomizer 60, a semiconductor switch 70, a display module 80, and a speaker 90. The power supply battery 20, the smoking signal detecting module 30, the memory 40, the data transmission module 50, the semiconductor switch 70, the display module 80, and the speaker 90 are all connected with the microcontroller 10. The semiconductor switch 70 is also connected with the power supply battery 20 and the atomizer 60. The microcontroller 10 can control the semiconductor switch 70 to be ON or OFF. When the semiconductor switch 70 is ON, the power supply battery 20 supplies power to the atomizer 60. When the semiconductor switch 70 is OFF, the power supply battery 20 stops supplying power to the atomizer 60. The semiconductor switch 70 is any one of a triode, a MOSFET, a transistor and a thyristor.

The smoking signal detecting module 30 is configured to detect smoking signals and send detected smoking signals to the microcontroller 10. The smoking signal detecting module 30 is a sensor or an input module. The input module is keyboard input module or a touch screen input module. The sensor may be a baroceptor or a gas flow transducer.

The microcontroller 10 is configured to record a time of each reception of the smoking signals and a continuation time length of each received smoking signal after receiving the smoking signal from the smoking signal detecting module 30. Then the microcontroller 10 is further configured to calculate smoking data according to time of each reception of the smoking signals and the continuation time length of each received smoking signal. The smoking data includes a time interval between every two adjacent smoking signals and the number of receiving the smoking signal during a preset period.

The microcontroller 10 is also configured to compare the number of receiving the smoking signal with a first preset threshold and/or compare the continuation time length of each received smoking signal with a second preset threshold. When the number of receiving the smoking signal exceeds the first threshold and/or the continuation time length of each received smoking signal exceeds the second threshold, the microcontroller 10 controls the semiconductor switch to be OFF, and further controls the speaker 90 or the display module 80 to output prompting message. The prompting message can be an audible message output from the speaker 90, or a visible message output from the display module 80. The first threshold and second threshold can be preset with the input module of the electronic cigarette.

The microcontroller 10 may be a MCU or a CPU, for example, a MSP430F5529 MCU, or an ARM7 CPU.

The memory 40 is configured to store the time of each reception of the smoking signals, the continuation time length of each received smoking signal and the smoking data. The memory 40 may be a flash memory chip or an EEPROM chip.

The data transmission module 50 is configured to transmit the smoking data stored by the memory 40 to an external device. The data transmission module 50 is also configured to transmit electric quantity of the power supply battery 20 to the external device. The external device can be a computer, a special device for analyzing data, or other devices. The data transmission module 50 can transmit the data in the form of cabled data transmission or wireless data transmission. If the data transmission module 50 transmits the data in the form of cabled data transmission, the data transmission module 50 can be any one of an USB interface, an I2C interface, an RS232 interface, an SPI interface. If the data transmission module 50 transmits the data in the form of wireless data transmission, the data transmission module 50 can be any one of a wifi module, a Zigbee module, a Bluetooth module and an NFC module. Moreover, the data transmission module 50 can also be an infrared interface, or a radio frequency interface that transmits the data at the frequency of 315 MHz, 433 MHz or 900 MHz.

The display module 80 is configured to display data. The microcontroller 10 displays data stored in the memory 40 via the display module 80. The display module 80 may be a LCD panel or a LED panel.

The microcontroller 10 can also be configured to obtain the number and time of charging processes of the power supply battery 20, and then store the number and time of charging processes of the power supply battery 20 in the memory 40. The number and the time of charging processes of the power supply battery 20 are transmitted to the external device through the data transmission module 50.

Figure 2:
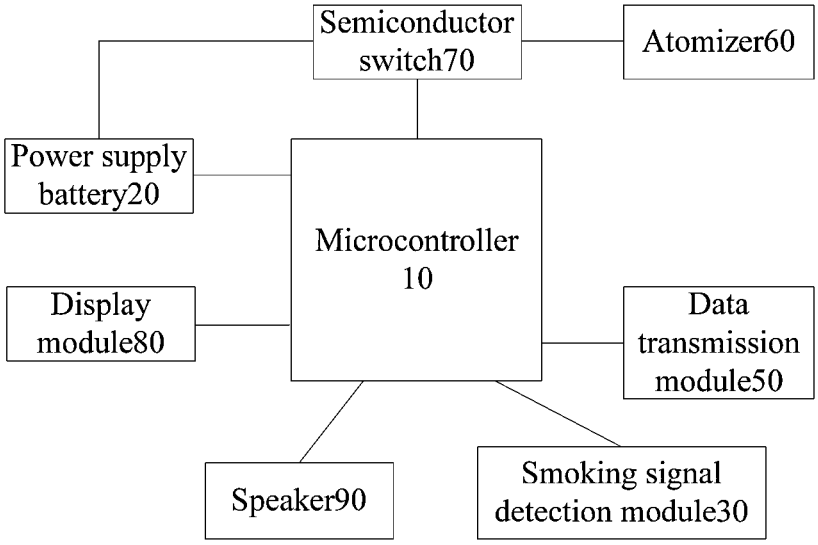
FIG. 2 is a block diagram of an electronic cigarette according to a second embodiment of the present invention.

As shown in FIG. 2, a structure diagram of an electronic cigarette according to a second embodiment of the present invention. In this embodiment, the electronic cigarette includes a microcontroller 10, a power supply battery 20, a smoking signal detecting module 30, a data transmission module 50, an atomizer 60, a semiconductor switch 70, and a display module 80. Wherein connection relations and functions of the power supply battery 20, the smoking signal detecting module 30, the data transmission module 50, the atomizer 60, the semiconductor switch 70, and the display module 80 are similar as that of the first embodiment, and do not require to be described herein again. In this embodiment, the microcontroller 10 inherently has a function of storing data.

The microcontroller 10 is configured to record the time of each reception of the smoking signals and a continuation time length of each received smoking signal after receiving the smoking signal from the smoking signal detecting module 30. Then the microcontroller 10 is further configured to calculate smoking data according to the time of each reception of the smoking signals and the continuation time length of each received smoking signal and stores the smoking data. The smoking data includes a time interval between every two smoking signals and the number of receiving the smoking signal during a preset period.

The microcontroller 10 transmits the stored smoking data to the external device through the data transmission module 50 and/or displays the smoking data using the display module 80.

In the embodiment of the present invention, if the data transmission module 50 is any one of a wifi module, a Zigbee module, a Bluetooth module, a NFC module, an infrared interface or a radio frequency interface, the data transmission module 50 should be received inside the inner of the electronic cigarette and connected with the microcontroller 10. Wherein, the radio frequency interface transmits the data in the frequency of 315 MHz, 433 MHz or 900 MHz. If the data transmission module 50 is any one of a USB interface, an I2C interface, a RS232 interface, or a SPI interface, the data transmission module 50 should be positioned on the outside of the electronic cigarette to be connected with the external device.

Figure 3:
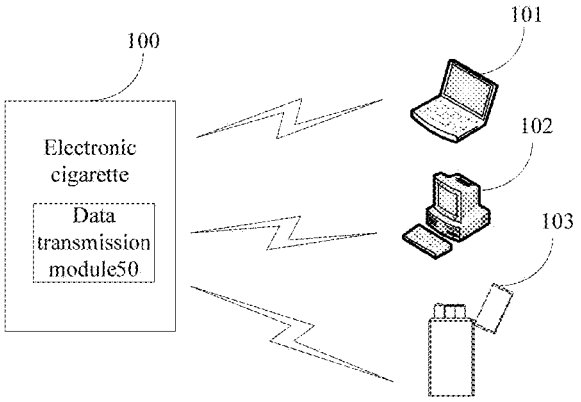
FIG. 3 is a schematic view of data transmission between an electronic cigarette and an external device according to one embodiment of the present invention and external devices.

As shown in FIG. 3, a schematic view of data transmission between an electronic cigarette and an external device according to one embodiment of the present invention. The data transmission module 50 of the electronic cigarette is any one of a wifi module, a Zigbee module, a Bluetooth module, or a NFC module, and can transmit data in the form of wireless data transmission to the external device, such as computer 101, a special analyzing device 102, or an electronic cigarette case 103. If the data transmission module 50 transmits the data to the external device in the form of wireless data transmission, the external device should be provided with the same module for receiving correct data from the data transmission module 50, such as a wifi module, a Zigbee module, a Bluetooth module, or an NFC module. The microcontroller 10 controls the data transmission module 50 to start and stop working. since the data of the electronic cigarette 100 can be transmitted to the electronic cigarette case 103, although the electronic cigarette 100 is housed in the electronic cigarette case 103, the electronic cigarette case 103 can obtain and display smoking data of the electronic cigarette 100, and users can easily know and further dispose the data.

Moreover, if the data transmission module 50 transmits the data to the external device in the form of cabled data transmission, the data transmission module 50 should be any one of a USB interface, an I2C interface, a RS232 interface, or a SPI interface, and can be connected with the external device through a data line to obtain the data. The data transmission module 50 may be an infrared interface, or a radio frequency interface that transmits the data at the frequency of 315 MHz, 433 MHz or 900 MHz.

Figure 4:
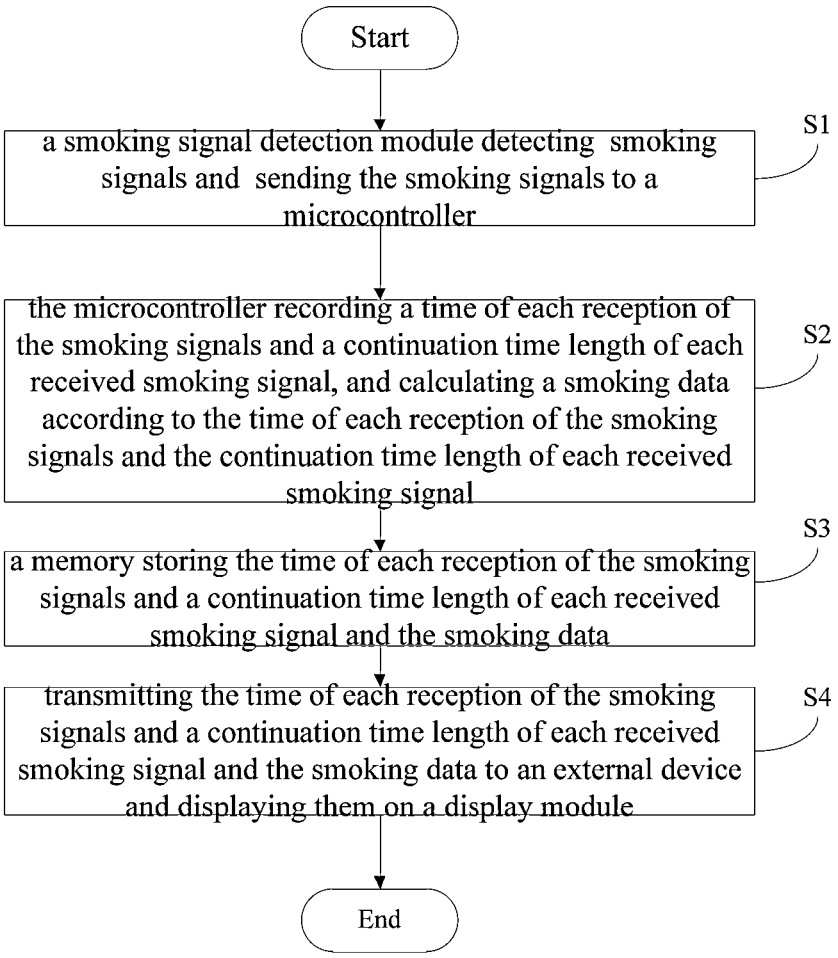
FIG. 4 is a flow chart of a method for disposing a smoking data of an electronic cigarette according to one embodiment of the invention.

As shown in FIG. 4, a flow chart of a method for disposing a smoking data of an electronic cigarette according to one embodiment of the invention. In the embodiment, the electronic cigarette includes a microcontroller, a smoking signal detecting module, a data transmission module, a display module, a atomizer and a power supply battery, wherein the smoking signal detecting module, the data transmission module, the display module, the atomizer and the power supply battery are all connected with the microcontroller. The method for disposing a smoking data of an electronic cigarette includes the following steps:

S1. the smoking signal detecting module detecting a smoking signal and sending the smoking signal to the microcontroller.

S2. the microcontroller recording a time of each reception of the smoking signals and a continuation time length of each received smoking signal, and calculating smoking data according to the time of each reception of the smoking signals and a continuation time length of each received smoking signal.

S3. the memory storing the time of each reception of the smoking signals, the continuation time length of each received smoking signal and the smoking data. During this step S3, the time of each reception of the smoking signals, the continuation time length of each received smoking signal and the smoking data are stored in the storage unit of the microcontroller or individual storage module connected with the microcontroller, which may be a flash memory chip or an EEPROM chip. The smoking data includes a time interval between every two adjacent smoking signals and a number of receiving the smoking signal during a preset period.

For example, table 1 shows case of a user of the electronic cigarette using the electronic cigarette on one day detected by a smoking signal detecting module of the electronic cigarette.

| | time of each reception of the smoking signal | | | | | |
|---|---|---|---|---|---|---|
| | t1 2013.01.01 09:00:00 | t2 2013.01.01 9:00:50 | t3 2013.01.01 9:02:00 | t4 013.01.01 12:30:00 | t5 2013.01.01 12:31:00 | t6 2013.01.01 12:31:30 |
| continuation time length of each received smoking signal | 2 s | 2 s | 2 s | 2.5 s | 2 s | 3 s |

The microcontroller calculates the number of receiving the smoking signal and the time interval between every two smoking signals according to the time of each reception of the smoking signals and the continuation time length of each received smoking signal. In this embodiment, the preset period may be 24 hours. Therefore, it can be calculated that the time interval between every two smoking signals includes: t2−t1=50 s, t3−t2=70 s, t4−t3=12480 s, t5−t4=60 s, t6−t5=30 s. Thus, the number of receiving the smoking signal across the 24 hours is 6.

S4. transmitting the time of each reception of the smoking signals, the continuation time length of each received smoking signal and the smoking data to an external device and displaying them on a display module.

wherein the smoking data includes a time interval between every two smoking signals and a number of receiving the smoking signal during a preset period.

Figure 5:
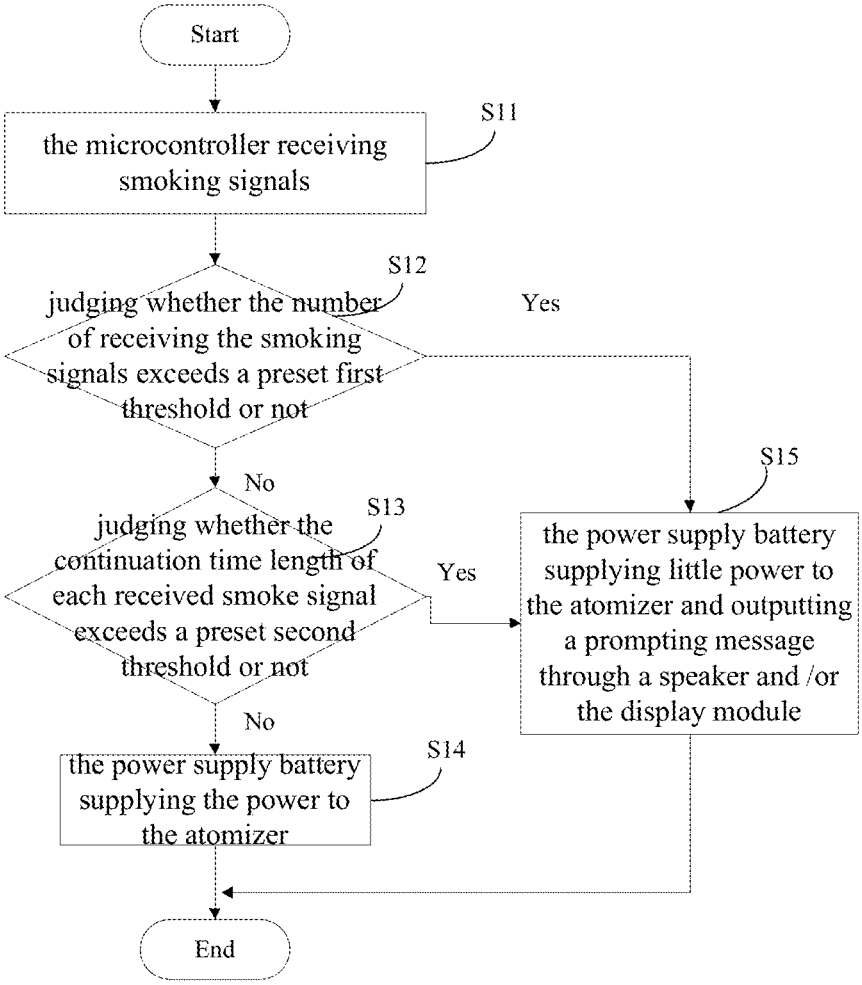
FIG. 5 is a flow chart of steps further included by the method for disposing a smoking data of an electronic cigarette according to one embodiment of the invention as shown in FIG. 4.

As shown in FIG. 5, the method for disposing a smoking data of an electronic cigarette further includes the following steps:

S11. the microcontroller receiving smoking signals, and the smoking signal detecting module obtaining the smoking signals;

S12. judging whether the number of receiving the smoking signal exceeds a preset first threshold or not; if the number of receiving the smoking signal exceeds the first threshold, executing S15, if the number of receiving the smoking signal does not exceed the first threshold, executing S13;

S13. judging whether the continuation time length of each received smoking signal exceeds a preset second threshold or not; if the continuation time length of each received smoking signal exceeds the second threshold, executing S15, if the continuation time length of each received smoking signal does not exceed the second threshold, executing S14;

S14. the power supply battery supplying the power to the atomizer;

S15. the power supply battery supplying little power to the atomizer and outputting a prompting message through a speaker and/or the display module.

During the step S12 and S13, users can preset the first threshold and the second threshold with the input module of the electronic cigarette. For example, the preset first threshold is 20 and the preset second threshold is 2 s such that when the received continuation time length of each received smoking signal exceeds 2 s, the power supply battery stops supplying power to the atomizer. As shown in table 1, the continuation time length of each received smoking signal for smoking exceeds 2 s at 12:30 on Jan. 1, 2013, and the power supply battery stops supplying power to the atomizer. The power supply battery starts to supply the power to the atomizer until detecting the smoking signal in the next time. When the number of detecting smoking actions of the user during 24 hours exceeds 20, the prompting message will be provided by the speaker or the display module and the power supply battery stops supplying power to the atomizer.

The smoking data of the users can be recorded and stored by the way that provided by the present invention, and it also can be transmitted to the external device to be analyzed and processed. Moreover, when the number of using the electronic cigarette during the preset period by users exceeds the preset threshold, the electronic cigarette also can prompt the users and stop working so that the number for smoking can be controlled to make the users use the electronic cigarette properly.

While the present invention has been described by reference to preferred embodiments, it will be understood by those skilled in the art that various changes may be made and equivalents may be substituted without departing from the scope of the present invention. However, all the changes will be included within the scope of the appended claims.

What is claimed is:

1. An electronic cigarette, comprising: a microcontroller, a smoking signal detecting module, a memory, a data transmission module, a display module, a speaker, a semiconductor switch and an atomizer and a power supply battery, the smoking signal detecting module, the memory, the data transmission module, the display module, the speaker and the semiconductor switch is connected with the microcontroller respectively, the semiconductor switch is connected with the atomizer and the power supply battery;

wherein the smoking signal detecting module is configured to detect smoking signals and send data regarding said smoking signals to the microcontroller;

wherein the microcontroller is configured to record a time of each reception of the smoking signals and a continuation time length of each received smoking signal, and calculate a smoking data according to the time of each reception of the smoking signals and a continuation time length of each received smoking signal;

wherein the memory is configured to store the time of each reception of the smoking signals, and the continuation time length of each received smoking signal;

wherein the smoking data includes a time interval between every two smoking signals and the number of receiving the smoking signal during a preset period;

wherein the data transmission module is configured to transmit the time of each reception of the smoking signals and a continuation time length of each received smoking signal and the smoking data to an external device; the smoking signal detecting module is a sensor or an input module; the input module is a keyboard or a touch screen;

wherein the display module is configured to display the time of each reception of the smoking signals and a continuation time length of each received smoking signal and the smoking data; wherein the display module is an LCD panel or an LED panel;

wherein the microcontroller is also configured to compare the number of reception of the smoking signal with a preset first threshold, and compare the continuation time length of each received smoking signal with a preset second threshold;

wherein when the number of receiving the smoking signal exceeds the first threshold and the continuation time length of each received smoking signal exceeds the second threshold, the microcontroller controls the semiconductor switch to be OFF and the power supply battery stops supplying power to the atomizer; wherein the electronic cigarette further comprises a speaker, the microcontroller further controls the display module and/or the speaker to output prompting message for users; the semiconductor switch is any one of a triode, a MOS tube, a transistor and a thyristor; the memory is a flash memory chip or an EEPROM chip; the microcontroller is a MCU or a CPU; and wherein the data transmission module is a radio frequency interface, and the radio frequency interface transmits the data in the frequency of 315 MHz, 433 MHz or 900 MHz.

2. A control method for an electronic cigarette comprising the following steps:

a smoking signal detecting module detecting a smoking signal and sending data regarding said smoking signal to a microcontroller;

the microcontroller recording a time of each reception of the smoking signals and a continuation time length of each received smoking signal, and calculating a smoking data according to the time of each reception of the smoking signals and a continuation time length of each received smoking signal;

a memory storing the time of each reception of the smoking signals, the continuation time length of each received smoking signal and the smoking data;

wherein the smoking data includes a time interval between every two smoking signals and the number of receiving the smoking signal during a preset period;

wherein the method further comprises: transmitting of each reception of the smoking signals and a continuation time length of each received smoking signal and the smoking data to an external device and displaying them on a display module;

wherein the method further comprises: comparing the number of receiving the smoking signal with a preset first threshold and comparing the continuation time length of each received smoking signal with a preset second threshold; wherein when the number of receiving the smoking signal exceeds the first threshold and the continuation time length of each received smoking signal exceeds the second threshold, the microcontroller controls a semiconductor switch to be OFF and a power supply battery stops supplying power to an atomizer; the microcontroller further controls the display module and/or a speaker to output prompting message for users; and wherein the data transmission module is a radio frequency interface, and the radio frequency interface transmits the data in the frequency of 315 MHz, 433 MHz or 900 MHz.

* * * * *